US009695582B2

(12) United States Patent
Mahler

(10) Patent No.: US 9,695,582 B2
(45) Date of Patent: Jul. 4, 2017

(54) DRAINAGE FITTING FOR A CISTERN

(71) Applicant: GEBERIT INTERNATIONAL AG, Jona (CH)

(72) Inventor: Alfred Mahler, Ruti (CH)

(73) Assignee: GEBERIT INTERNATIONAL AG, Jona (CH)

( * ) Notice: Subject to any disclaimer, the term of this patent is extended or adjusted under 35 U.S.C. 154(b) by 69 days.

(21) Appl. No.: 14/524,050

(22) Filed: Oct. 27, 2014

(65) Prior Publication Data

US 2015/0113720 A1 Apr. 30, 2015

(30) Foreign Application Priority Data

Oct. 28, 2013 (EP) ..... 13190455

(51) Int. Cl.

| | |
|---|---|
| ***E03D 1/35*** | (2006.01) |
| ***E03D 3/12*** | (2006.01) |
| ***E03D 1/14*** | (2006.01) |
| ***E03D 1/34*** | (2006.01) |

(52) U.S. Cl.

CPC ..... *E03D 3/12* (2013.01); *E03D 1/144* (2013.01); *E03D 1/34* (2013.01); *E03D 1/35* (2013.01); *E03D 2001/147* (2013.01)

(58) Field of Classification Search

CPC .. E03D 1/14; E03D 1/144; E03D 1/34; E03D 1/35; E03D 2001/147

USPC .... 4/324, 325, 378, 379, 388, 384, 381, 385

See application file for complete search history.

(56) References Cited

U.S. PATENT DOCUMENTS

| | | | | | |
|---|---|---|---|---|---|
| 2,077,832 | A * | 4/1937 | Gebert | E03D 1/34 | 4/391 |
| 3,705,428 | A * | 12/1972 | Braswell | E03D 1/34 | 4/388 |
| 4,176,821 | A * | 12/1979 | Strangfeld | E03D 1/34 | 251/144 |
| 4,557,000 | A * | 12/1985 | Strangfeld | E03D 1/142 | 251/25 |
| 4,651,359 | A * | 3/1987 | Battle | E03D 1/144 | 4/324 |
| 4,882,793 | A * | 11/1989 | Thompson | E03D 1/142 | 4/324 |
| 5,023,960 | A * | 6/1991 | Ratanagsu | E03D 1/34 | 4/324 |
| 5,305,474 | A * | 4/1994 | Nardi | E03D 1/142 | 4/324 |
| 5,331,690 | A * | 7/1994 | Pourcier | E03D 1/142 | 4/324 |
| 5,392,470 | A * | 2/1995 | Johnson | E03D 1/144 | 4/325 |

(Continued)

FOREIGN PATENT DOCUMENTS

| | | |
|---|---|---|
| DE | 92 15 972 U1 | 4/1994 |
| EP | 0 722 020 A1 | 7/1996 |
| WO | 02/01010 A1 | 1/2002 |

*Primary Examiner* — Erin Deery

(74) *Attorney, Agent, or Firm* — Sughrue Mion, PLLC

(57) ABSTRACT

A drainage fitting (1) for a cistern, including a valve body (2) with a sealing element (4), which cooperates with a valve seat (3), and a float (5), wherein the valve body (2) is movable with the sealing element (4) from the valve seat (3) along a movement axis (B) from a rest position into a flushing position and from the flushing position into the rest position. Furthermore the drainage fitting comprises a full and a part volume control unit which onto the valve body.

30 Claims, 5 Drawing Sheets

(56) References Cited

U.S. PATENT DOCUMENTS

| | | | | | |
|---|---|---|---|---|---|
| 5,653,252 | A * | 8/1997 | Steg | E03D 1/30 | 137/15.26 |
| 5,657,494 | A * | 8/1997 | Diethelm | E03D 1/142 | 137/398 |
| 5,713,086 | A * | 2/1998 | Diethelm | E03D 1/144 | 4/325 |
| 5,926,861 | A * | 7/1999 | Frost | E03D 1/142 | 4/324 |
| 6,006,371 | A * | 12/1999 | Korte | E03D 1/34 | 4/391 |
| 6,081,938 | A * | 7/2000 | McClure | E03D 1/142 | 4/324 |
| 6,094,753 | A * | 8/2000 | Korte | E03D 1/144 | 4/325 |
| 6,584,622 | B1 * | 7/2003 | Nilsson | E03D 1/142 | 4/324 |
| 7,353,547 | B2 * | 4/2008 | Diethelm | E03D 1/144 | 4/378 |
| 7,996,927 | B2 * | 8/2011 | Mahler | E03D 1/144 | 4/325 |
| 8,185,976 | B2 * | 5/2012 | Le | E03D 1/144 | 4/324 |

* cited by examiner

DRAINAGE FITTING FOR A CISTERN

TECHNICAL SCOPE

The present invention relates to a drainage fitting or an outlet valve for a cistern according to the preamble of Claim 1.

PRIOR ART

Drainage fittings for selectively triggering a full volume flush or a part volume flush are known from the prior art.

For example, EP 0 722 020, corresponding to U.S. Pat. No. 5,657,494, the contents of which are incorporated by reference, describes a cistern of this type. A weight body, which can be connected in a selective manner to the valve body, is arranged for the part volume flush.

Although, with reference to reliability and longevity, the cistern of EP 0 722 020 is realized extraordinarily well and highly satisfactorily, the control unit or the flushing volume is only adjustable in a very restricted manner.

REPRESENTATION OF THE INVENTION

Proceeding from said state of the art, the object underlying the invention is to provide a drainage fitting which overcomes the disadvantages of the prior art. In particular, a drainage fitting is to be provided by way of which a more flexible adjustment of the full volume flush and of the part volume flush is able to be achieved. In particular, a larger adjustment range is to be achieved for both the flushing volumes.

Said object is achieved by the claimed invention. Accordingly, a drainage fitting includes a valve body with a sealing element, which cooperates with a valve seat, and a float, wherein the valve body is movable with the sealing element from the valve seat along a movement axis from a rest position into a flushing position and from the flushing position into the rest position, a full volume control unit for controlling a full volume flush, wherein the full volume control, when achieving a water level provided for the full volume, provides a closing force onto the valve body, and a part volume control unit for controlling a part volume flush, wherein the part volume control, when achieving a water level provided for the part volume, provides a closing force onto the valve body. In addition, the drainage fitting includes a partition wall with a float chamber which is located below said partition wall, wherein the valve body extends through an opening through the partition wall, wherein the float is movable inside the float chamber along the actuating axis and cooperates with said float chamber in a hydraulic manner. The partition wall comprises a full volume control opening and a part volume control opening, through which air and/or water is able to pass from the top side of the partition wall under said partition wall in such a manner that the pressure conditions between the float chamber and the regions outside the float chamber can be equalized. The hydraulic balance inside the float chamber is therefore disturbed. The state of the full volume control opening is controllable by the full volume control unit and the state of the part volume control opening is controllable by the part volume control unit.

As a result of the arrangement of the control openings in the partition wall, the region above the partition wall remains substantially free. Said region can then be used for developing the part volume control unit and the full volume control unit. Consequently, as a result of the arrangement of the control openings in the partition wall, greater scope for development is created when realizing the control units.

In the case of a full volume flush, the full volume control opening is open and the part volume control opening is closed. In the case of a part volume flush, the part volume control opening is open and the full volume control opening is closed.

The closing force is a mechanical closing force which acts on the float in the direction of the movement axis. The closing force is provided by mechanical contact between parts of the full volume control unit or of the part volume control unit. The control openings are controlled according to the intended flushing as a result of actively actuating the full volume control opening and the part volume control opening. Consequently, a mechanical force component which acts on the valve body as a result of the closing force and a hydraulic component which is provided by the actuation of the control opening, therefore act on the valve body during the closing operation. The mechanical closing force can be reduced as a result of hydraulic influence via the active actuation of the control openings.

As a result of the arrangement of the float in a float chamber, which is flooded with flushing water in operation, the float is held in the float chamber by negative pressure in the flushing position. Said negative pressure is eliminated or equalized to the pressure level at the regions outside the float chamber as soon as the control openings are controlled in a corresponding manner. The float chamber is defined toward the top by the partition wall and to the bottom a side wall extends which connects to the partition wall. The side wall comprises an edge region which is located at a spacing to the valve seat such that the flushing water is able to flow between the edge and the valve seat for draining the cistern.

In a further development, the closing force of the respective control unit is applied directly to the valve body or is applied to the valve body from the respective control unit via a switching member.

Each of the control units preferably includes a closing member which cooperates with the respective control opening, wherein the closing member is movable relative to the corresponding control opening. The full volume control opening and the part volume control opening can therefore be actuated in an active manner by way of the closure member, which is part of the full volume control unit or of the part volume control unit.

In a preferred manner, the full volume control unit includes an actuating rod which projects through the full volume control opening and acts directly on the float. Said closing force can be applied onto the valve body by means of the float via the actuating rod. The actuating rod, in this case, is movable relative to the fixed partition wall.

The actuating rod preferably projects so far into the float chamber that, when the float moves from the rest position into the flushing position, the actuating rod and further parts of the full volume control unit are raised.

The closing member is preferably arranged in a front end region of the actuating rod. The closing member cooperates with the control opening.

The closing member is preferably located inside the float chamber in such a manner that the full volume control opening is closable when the valve body is situated in the rest position. The control opening remains closed until the water level has gone down to the full volume level, the control opening then being opened by the full volume control unit.

The full volume control unit preferably includes an actuating element with a water chamber, the actuating element communicating with the actuating rod. The actuating element can preferably be displaced and locked relative to the actuating rod such that its height in the cistern is adjustable. The actuating rod preferably comprises latching elements for this purpose.

As the flushing water rises in a cistern, the water chamber is filled with the flushing water. As soon as the water level then falls into the region of the actuating element, the flushing water in the water chamber become active as a weight force and provides the said closing force onto the valve body. At the same time as the weight force is inserted or briefly thereafter, the closing member of the full volume control unit is moved away from the full volume control opening and the float chamber is opened. Air and/or water can also enter the float chamber through the full volume control opening, as a result of which the hydraulic balance inside the float chamber is disturbed. As a result of this, the valve body is moved from the flushing position into its rest position.

The part volume control unit remains closed during the full volume flush. The part volume control unit remains substantially in its rest position during the full volume flush and is not actuated.

The actuating rod of the full volume control unit is preferably mounted on a retaining element in the flushing position. In particular, the retaining element provides a stop against movement beyond the flushing position.

In addition, the actuating rod is preferably movably mounted in a longitudinal guide. The longitudinal guide, in this case, extends in the actuating direction.

In a particularly preferred embodiment, the actuating element comprises an air chamber which is located below said water chamber such that the actuating element and consequently also the actuating rod as well as the closing member experience buoyancy and the closing member closes the full volume flush control opening when the cistern is filled.

The part volume control unit preferably includes a switching member which, when the part volume control unit is raised, automatically enters into a latching connection to the valve body. The mechanical closing force can be transferred from the part volume control unit to the vale body via said latching connection.

The part volume control unit preferably includes a rod, wherein a closing member is arranged on a front end region. The closing member, in this case, cooperates with the part volume control opening.

The closure member is preferably raised from the part volume control opening when the part control unit is actuated.

The closing member of the part volume control unit opens the part volume control opening preferably only when the part volume control unit is actuated. This means that otherwise, that is when the part volume control unit is not actuated, the part volume control opening remains closed. With the part volume control opening open, water is able to flow into the float chamber, the hydraulic balance then being correspondingly influenced.

The state of the full volume control opening is closed during part volume control. The closing member of the full volume control unit closes the full volume control opening such that the float chamber is closed upward. The closure is achieved, in particular, as a result of the buoyancy of the actuating element with the air chamber.

The closing member of the part volume flush unit is preferably located outside the float chamber.

The part volume control unit preferably includes an actuating element with a water chamber, wherein the actuating element is connectable to the valve body via the switching member and wherein the actuating element communicates with the rod, in particular so as to be adjustable. The water chamber provides a weight force when the cistern empties which then acts as a closing force. The closing force is transferred to the valve body via the switching member as mentioned.

The actuating element of the full volume control unit is located below the actuating element of the part volume control unit in the installed position. The height of both actuating elements in the cistern can preferably be adjusted.

In addition, the drainage fitting preferably comprises an actuating device. During the full volume flush, the actuating device acts directly on the valve body. The valve body is preferably raised in a corresponding manner. The full volume control unit acts on the valve body for movement from the flushing position into the rest position. In the case of the part volume flush, the actuating device acts on the valve body via the part volume control unit, the part volume control unit being raised during actuation and at the same time raising the valve body, wherein the part volume control unit is temporarily connectable to the valve body, in particular via the switching member.

The part volume control unit preferably comprises a sleeve which communicates with the rod and surrounds the valve body at least in part, wherein the valve body comprises a stop against which the sleeve bears during the part volume flush in such a manner that the valve body can be raised.

The valve body preferably comprises a receiving opening which engages with the actuating device and the part volume control unit comprises a receiving opening which engages with the actuating device. The elements are moved from the rest position into the flushing position via said receiving openings.

The actuating rods of the full volume control unit and the rod of the part volume control unit are preferably movable along a longitudinal direction parallel to the movement of the valve body.

The full volume control opening and the part volume control opening are preferably arranged in a portion of the partition wall which is located in the horizontal in the installed position.

In an especially preferred manner, the full volume control opening and the part volume control opening are located in the installed position on the same plane with reference to the horizontal.

The drainage fitting preferably further includes a housing which is fixedly connectable to the cistern, wherein the valve body is movably mounted in the housing. Over and above this, the housing preferably includes the float chamber and the partition wall.

In a further preferred embodiment, the closing members of the two control units can be nested in one another.

Further embodiments are provided in the dependent claims.

BRIEF DESCRIPTION OF THE DRAWINGS

Preferred embodiments of the invention are described below by way of the drawings which simply serve for explanation and are not to be deemed as restricting, in which.

DESCRIPTION OF PREFERRED EMBODIMENTS

Figure 1:
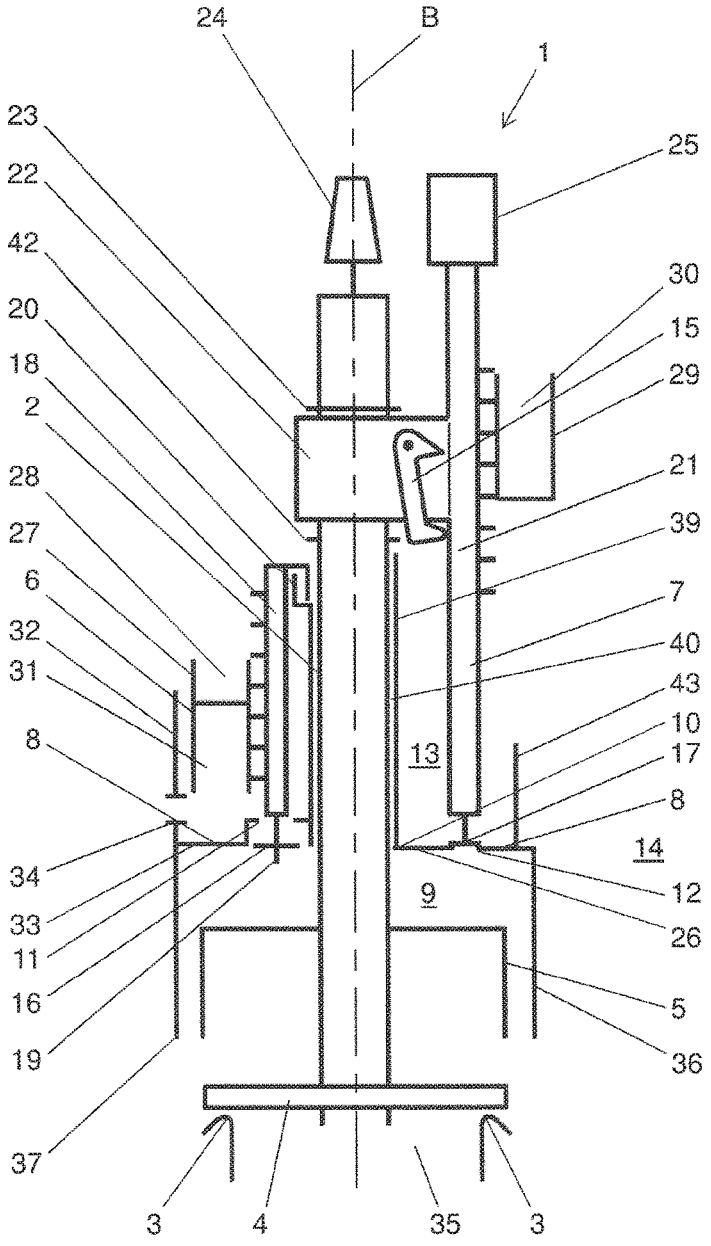
FIG. 1 shows a schematic view of a drainage fitting according to an embodiment after flushing has been carried out.

FIG. 1 shows a drainage fitting 1 for a cistern in the rest position. The cistern is not shown here. The drainage fitting 1 is connected to the cistern in the known manner and serves for controlling a part volume flush or a full volume flush. During flushing, a certain amount of water is supplied to a sanitary device such as a toilet or a urinal.

The drainage fitting 1 includes a valve body 2 with a sealing element 4 as well as a float 5, a full volume control unit 6 and a part volume control unit 7. In addition, the drainage fitting includes a partition wall 8 with a float chamber 9 which is located below said partition wall and in which the float 5 is arranged so as to be movable.

The valve body 2 is movable with the sealing element 4 from a valve seat 3 along a movement axis B from a rest position into a flushing position and from the flushing position into the rest position. In FIG. 1 the valve body 2 is situated in the rest position, the sealing element 4 abutting against the valve seat 3 in this case such that no water can be directed to the drain 35 which connects to the valve seat 3. The valve seat 3 and the drain 35 can be parts of the drainage fitting 1 or of the cistern.

The full volume control unit 6 serves for controlling a full volume flush. The full volume control unit 6 provides a closing force onto the valve body 2 when a water level that is provided for the full volume is reached, designated in the Figures by the reference VM. The full volume control unit 6 therefore brings about a mechanical closing force onto the valve body 2 such that it is moved back from the flushing position into the rest position.

The part volume control unit 7 serves for controlling a part volume flush. The part volume flush unit 7 also provides a closing force onto the valve body 2 when a water level that is provided for the part volume is reached, designated in the Figures by the reference TM. Here too, a mechanical force is provided on the valve body 2 such that it is moved back from the flushing position into the rest position.

As already mentioned, the drainage fitting 1 includes a partition wall 8 with a float chamber 9 which is located below said partition wall 8. The float chamber 9 is defined upward by the partition wall 8. A side wall 36 extends downward away from the partition wall 8 and defines the float chamber 9 at the side. The side wall 36 is connected to the partition wall 8 and surrounds said partition wall in a circumferential manner. The side wall 36 comprises an edge region 37 downward, that is toward the valve seat 3. Said edge region 37 is located at a spacing to the valve seat 3 such that a space 38, through which the flushing water 35 can be supplied, is created between the valve seat 3 and the edge region 37.

The partition wall 8 comprises an opening 10 through which the valve body 2 extends. The valve body 2 is mounted in the opening 10 so as to be movable along the movement axis B. The float 5, in this case, is located inside the float chamber 9 and is movable along the actuating axis B. In addition, the float 5 cooperates hydraulically with the float chamber 9. Due to an upward closure by means of the partition wall 8, with the float 9 raised when the valve body 2 is situated in the flushing position, there is hydraulic balance inside the float chamber 9, the float 5 being held in the flushing position on account of said balance. Put another way, negative pressure which holds the float 5 and consequently also the valve body 2 in the flushing position, is provided in the float chamber 9.

In the present embodiment, the opening 10 is supplemented upward by way of a circumferential wall 39. The wall 39 provides an opening 40 which correspondingly guides the valve body 2. The wall 39 extends completely around the opening 10, the wall 39 then providing the cylindrical, uninterrupted opening 40.

Two control openings 11, 12 are arranged in the partition wall 8. The hydraulic balance inside the float chamber 9 can be controlled via said control openings 11, 12 which can be opened and closed. If one of said control openings 11, 12 is opened when the float 5 is situated in the flushing position, the hydraulic balance in the floating chamber 9 is eliminated and the float 5 is moved along the actuating axis B in the direction of the valve seat 3.

A full volume control opening 11 and a part volume control opening 12 are arranged in the present embodiment. As a result of said control openings 11, 12, air and/or water is able to pass from the top side 13 of the partition wall 8 below said partition wall, that is into the float chamber 9. Consequently, the pressure conditions between the float chamber 9 and the regions 14 outside the float chamber 9 are equalizable. The regions 14 are provided by the cistern.

The state of the full volume control opening 11 is controlled by the full volume control unit 6 and the state of the part volume control opening 12 is controlled by the part volume control unit 7. In the case of the full volume flush, the full volume control opening 11 is opened and the part volume control opening 12 remains in the closed state. When the part volume control unit 7 is actuated, the actuation of the control openings 11, 12 is precisely the reverse, in this case the part volume control opening 12 is opened and the full volume control opening 11 remains closed. Consequently, during the closing operation, that is when the valve body 2 moves from the flushing position into the rest position, two different force components are always active. On the one hand, a mechanical closing force is provided on the valve body 2 and, on the other hand, a hydraulic component acts through the opening of the control openings 11, 12. The closing force, which is to be provided by the full volume control unit 6 or by the part volume control unit 7, can be reduced on account of the hydraulic control through the control openings 11, 12. The mass of the part volume control unit 7 or of the full volume control unit 6 can be correspondingly reduced as a result.

Figure 2:
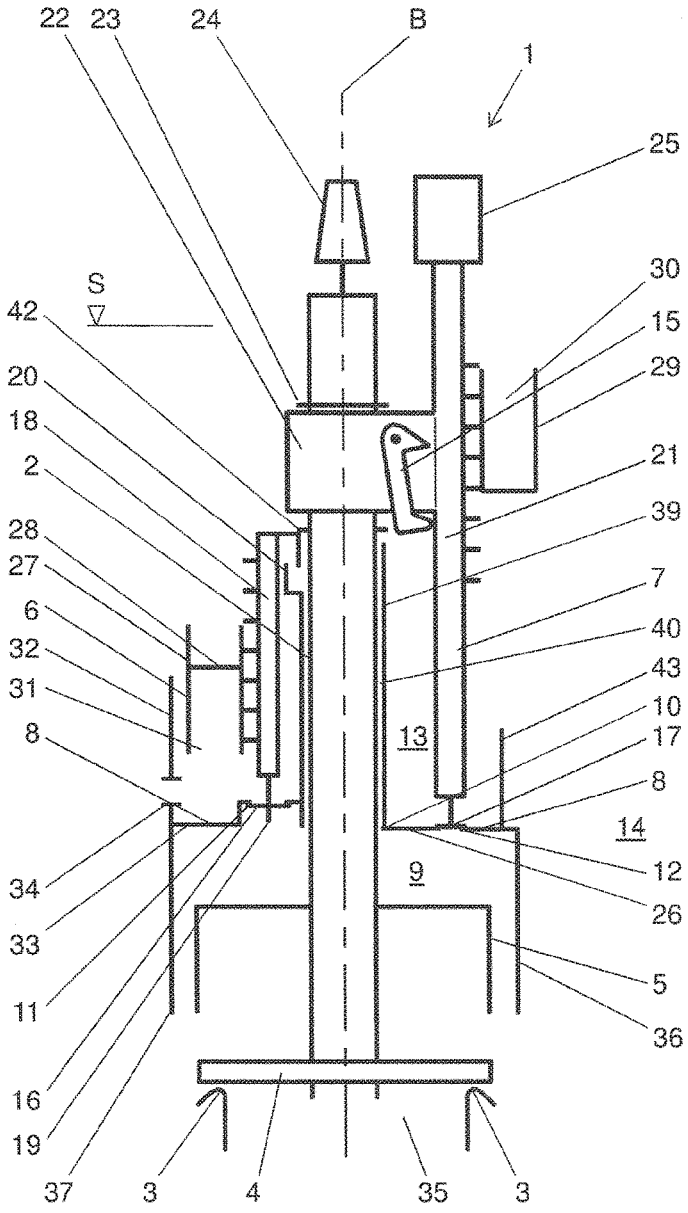
FIG. 2 shows a schematic view of the drainage fitting according to FIG. 1 with a filled cistern.

FIG. 2 now shows the drainage fitting 1 in the rest position with the cistern filled. The water level is shown by way of the reference S. Both control openings 11, 12 are closed by the respective control units 6, 7. The sealing element 4 rests on the valve seat 3.

Figure 3:
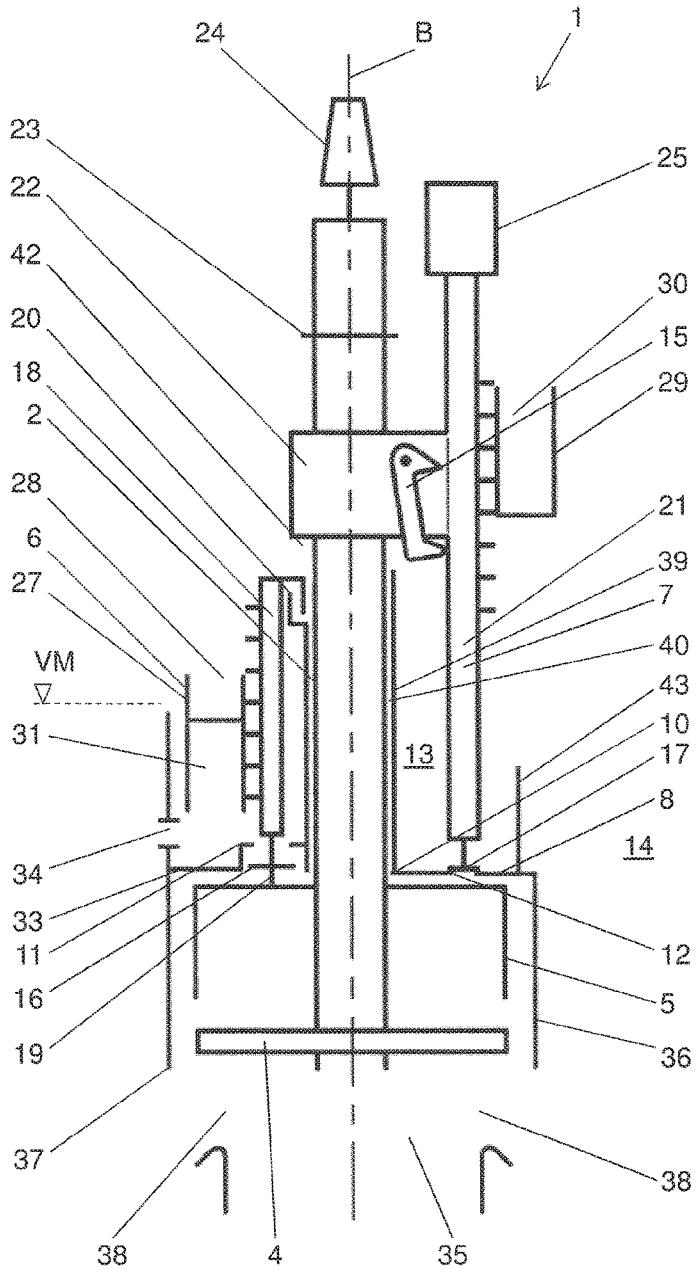
FIG. 3 shows the view of FIG. 1 in the flushing position for a full volume flush.

FIG. 3 shows the drainage fitting during the full volume flush. The sealing element 4, in this case, is located at a spacing to the valve seat 3. The entire valve body 2 is raised. The flushing water is able to pass through the space 38 to the outlet 35. The water level in the cistern goes down in a corresponding manner. As soon as the water level has then reached the level VM, the weight force of the full volume control unit 6 begins to act and the full volume control unit 6 provides a closing force onto the valve body 2, here onto the float 5. Said closing force presses the valve body 2 along the movement axis B in the direction of the valve seat 3. Prior to providing the force, the full volume control opening 11 is opened by the full volume control unit 6 and the hydraulic balance in the float chamber 9 is disturbed. Consequently, a hydraulic component is also provided on the valve body 2 which makes it possible for the valve body 2 to move in the direction of the valve seat 3. During said actuation, the part volume control opening 12 remains closed because the part volume control unit 7 is not actuated. The part volume control unit 7 is pressed against the part volume control opening 12 on account of its weight force.

Figure 4:
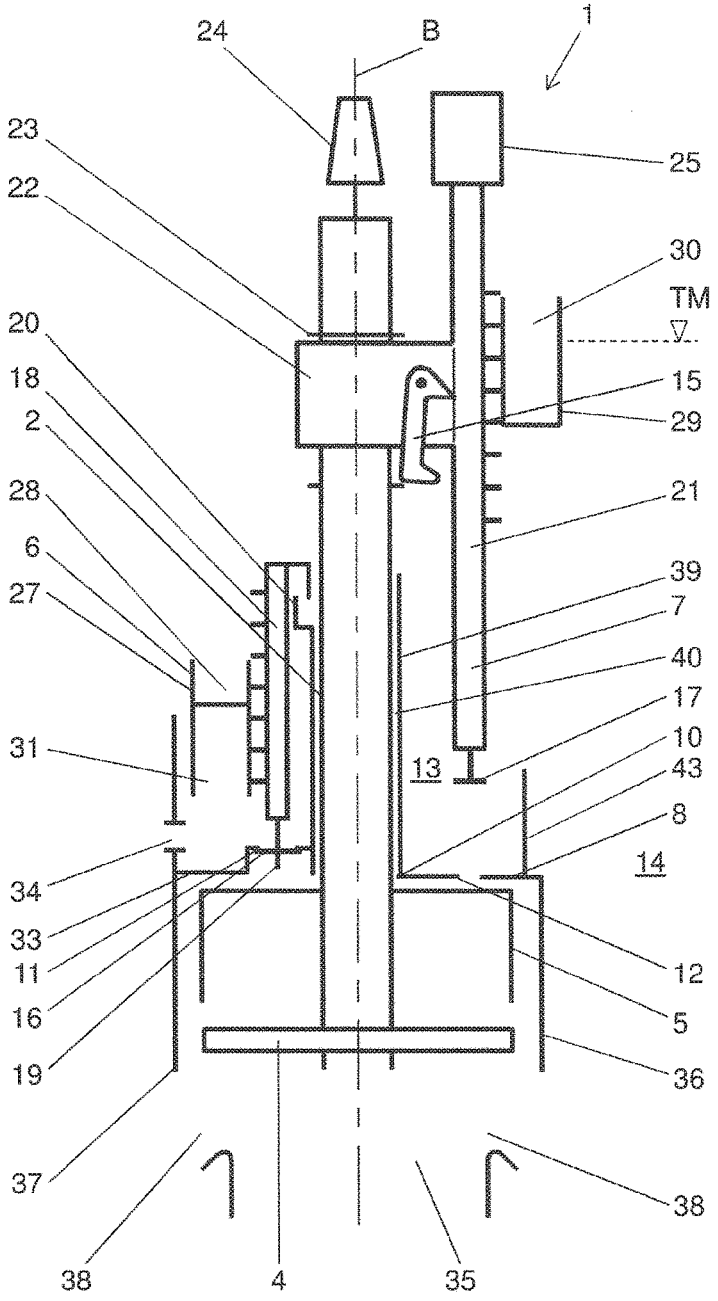
FIG. 4 shows the view of FIG. 1 in the flushing position for a part volume flush.

FIG. 4 shows the flushing of a part volume. In this case, the part volume control unit 7 is correspondingly actuated and raises the valve body 2. During the raising, the part volume control unit 7 is temporarily connected in a mechanical manner to the valve body 2 for the flushing operation. For this purpose a switching member 15 is provided in the embodiment shown. At the same time as the part volume control unit 7 is raised, the part volume control opening 12 is already opened. As soon as the flushing water level has gone down then to the water level for the part volume, the weight force of the part volume control unit 7 begins to act and provides a closing force on the valve body 2 via the switching member 15. The hydraulic balance inside the float chamber 9 is disturbed by the already opened part volume control opening 12. Water can pass into the float chamber 9 via the part volume control opening 12. Consequently, here too, mechanical and hydraulic force components act on the valve body 2 such that said valve body is able to be closed in a corresponding manner. The full volume control opening 11 remains closed.

Further features of the drainage fitting 1 according to the present embodiment are now described with reference to FIGS. 1 to 4.

Each of the control units 6, 7 includes a closing member 16, 17 which cooperates with the respective control opening 11, 12. The closing member 16, 17, in this case, is movable relative to the corresponding control opening 11, 12 by the control unit 6, 7. The closing member 16, 17 can be realized in a wide-ranging manner. In the present embodiment, each of the closing members 16 or 17 comprises a valve plate which is greater than the corresponding control opening 11, 12 and thus closes said control opening.

The full volume control unit 6 comprises an actuating rod 18. The actuating rod 18 projects through the full volume control opening 11 in the present embodiment and acts directly on the float 5. The closing force impinges on the float 5 via said actuating rod 18.

The actuating rod 18 communicates with an actuating element 27 in this case. In the present embodiment, the actuating element 27 comprises a water chamber 28 and an air chamber 31 which is located below the water chamber 28. The water chamber 28 is filled with flushing water when the water level rises in the cistern. The air chamber 31 provides for corresponding buoyancy such that the closing member 16 abuts against the full volume control opening 11 in the rest position. The actuating element 27 is realized so as to be displaceable and adjustable in relation to the actuating rod 18. Consequently, the height of the actuating element 27 can be adjusted in a corresponding manner in the installed state. The level of the full volume control and consequently also the volume removal from the cistern during the full volume control is controlled by said height adjustment.

It can be easily seen from FIG. 1 that the actuating rod 18 projects so far into the float chamber 9 that when the float moves from the rest position into the flushing position the actuating rod 18 and further parts of the full volume control unit 6 are raised.

The closing member 16 is arranged on the actuating rod 18 on a front end region 19 of the actuating rod 18. The closing member 16 is located inside the float chamber 9. The closing member 16 is located in such a manner in the float chamber 9 that the full volume control opening 11 is closable in the raised state. The closure is ensured by the buoyancy of the actuating element 27.

Figure 5:
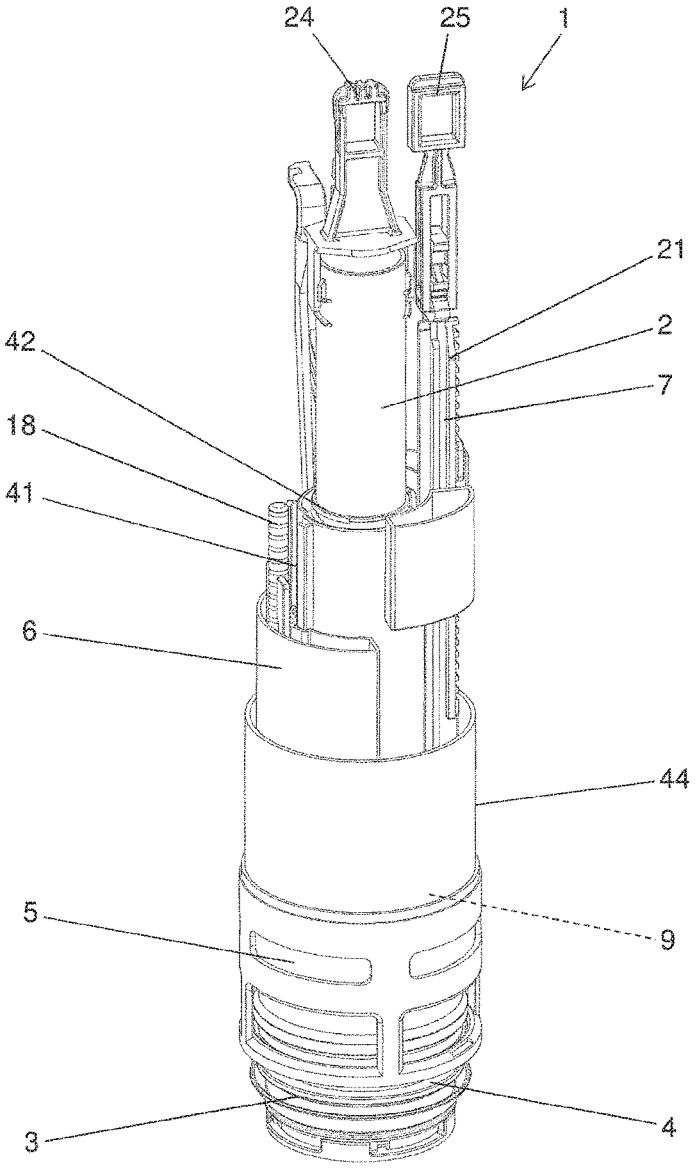
FIG. 5 shows a perspective view of a possible embodiment.

The actuating rod 18 of the full volume control unit 6 can be suspended on a retaining element 20 in the flushing position. The retaining element 20, in this case, provides a stop for the actuating rod 18 with reference to a movement in the direction of the float chamber 9. The function of said stop is shown correspondingly in FIG. 1. The actuating rod 18 is preferably guided on the drainage fitting in the region of the stop by way of a longitudinal guide. A longitudinal guide 41 is shown in FIG. 5 as an example.

As already mentioned above, the part volume control unit 7 includes a switching member 15. The switching member 15 which, in this case, comprises the form of a switching lever, is connected automatically to the valve body 2 when the part volume control unit 7 is raised. FIG. 2 shows that the switching member 15 bears against a stop element 42 on the valve body 2. As a result, the closing force is transferred in a corresponding manner from the part volume control unit 7 to the valve body 2. As soon as the valve body 2 is then located again in the rest position, the switching member 15 automatically pivots back such that the connection between the part volume control unit 7 and the valve body 2 is eliminated.

The part volume control unit 7 includes a rod 21, the closing member 17 being arranged on a front end region 19. When the part volume control unit 7 is actuated, the closure member 17 is raised correspondingly from the part volume control opening 12 and releases said part volume control opening. The closing member 17, in this case, is arranged outside the float chamber 9. The closing member 17 is moved toward the part volume control opening via the weight force of the part volume control unit 7.

Like the full volume control unit 6, the part volume control unit 7 also comprises an actuating element. The actuating element of the part volume control unit 7 bears the reference 29. The actuating element 29, in this case, includes a water chamber and communicates with the rod 21. The actuating element 29 can preferably be displaced and adjusted in a relative manner along the rod 21. The height of the water level for the part volume control can be correspondingly adjusted as a result. The actuating element 29 can be connected to the valve body 2 via the switching member 15. As soon as the water level drops to the height TM, the water situated in the water chamber 30 acts as a weight and acts on the valve body 2 via the switching member 15 such that said valve body is movable from the flushing position into the rest position. The mechanical closing force is provided as a result.

The drainage fitting 1 preferably comprises an actuating device, not shown here. In the case of a full volume flush, the actuating device acts directly onto the valve body 2. For this purpose, the valve body 2 comprises on its upper end a receiving opening 24 into which the actuating device is able to engage in a corresponding manner. In the case of a part volume flush, the actuating device acts on the valve body 2 via the part volume control unit 7. On actuation, the part volume control unit 7 is correspondingly raised and at the same time raises the valve body 2. Equally during raising, the part volume control unit 7 is temporarily connected to the valve body 2 via the switching member 15 such that the closing force can be transferred from the part volume control unit 7 to the valve body 2.

For transferring the movement to the valve body 2, the part volume control unit 7 comprises a sleeve 22 which communicates with the rod 21. The sleeve 22 engages around the valve body 2 at least in part. The valve body 2 comprises a stop 23 against which the sleeve 22 bears during the part volume flush in such a manner that the valve body 2 can be raised in a corresponding manner. The stop 23 is therefore located above the sleeve 22. The part volume control unit 7 comprises a receiving opening 25. The receiving opening 25 communicates with the part volume control unit 7 in this case in the region of the rod 21. The receiving opening 25 serves for engagement with the actuating device. The part volume control unit 7 is correspondingly raised via said receiving opening.

With reference to the movements, it must be noted that the part volume control unit 7 and also the full volume control unit 6 are moved substantially parallel to the movement of the valve body.

As can be seen from the Figures, the full volume control opening 11 and the part volume control opening 12 are located in a portion 26 of the partition wall 8 which is located in the horizontal in the installed position. In an especially preferred manner, the full volume control opening 11 and the part volume control opening 12 are substantially on the same plane. This, in turn, with reference to the horizontal. As an alternative to this, the height of the two control openings 11, 12 can also be offset with respect to one another.

The actuating element 27 of the full volume control unit 6 is movable in a container 32. The container 32 is connected to the partition wall 8. The container comprises an outlet opening 34 above the partition wall 8 in the region of the container bottom 32. The function of the container is substantially to brake the downward movement of the full volume control unit 6 slightly by the water situated in the container 32 being pressed slowly outward via the outlet opening 34.

A corresponding container 43 is also provided in the region of the part volume control unit 7. Said container 43 essentially ensures that the hydraulic balance inside the float chamber is not eliminated too prematurely when a part volume flush is introduced. In other words it can be said that the container 43 is arranged in the region of the part volume control opening and extends away from the partition wall 9.

FIG. 5 shows a perspective view of a preferred embodiment of the drainage fitting 1. The drainage fitting 1 further includes, in this case, a housing 44 which is fixedly connectable to the cistern. The valve body 2 and the other movable elements, in this case, communicate in a corresponding manner with the housing 44. In the image in FIG. 5 it can also easily be seen that the actuating elements 27, 29 are realized so as to be height-adjustable along the corresponding rods 18, 21.

| LIST OF REFERENCES | |
|---|---|
| 1 | Drainage fitting |
| 2 | Valve body |
| 3 | Valve seat |
| 4 | Sealing element |
| 5 | Float |
| 6 | Full volume control unit |

-continued

| LIST OF REFERENCES | |
|---|---|
| 7 | Part volume control unit |
| 8 | Partition wall |
| 9 | Float chamber |
| 10 | Opening |
| 11 | Full volume control opening |
| 12 | Part volume control opening |
| 13 | Top side |
| 14 | Regions |
| 15 | Switching member |
| 16 | Closing member |
| 17 | Closing member |
| 18 | Actuating rod |
| 19 | Front end region |
| 20 | Retaining element |
| 21 | Rod |
| 22 | Sleeve |
| 23 | Stop |
| 24 | Receiving opening |
| 25 | Receiving opening |
| 26 | Portion |
| 27 | Actuating element |
| 28 | Water chamber |
| 29 | Actuating element |
| 30 | Water chamber |
| 31 | Air chamber |
| 32 | Container |
| 33 | Container bottom |
| 34 | Outlet opening |
| 35 | Drain |
| 36 | Side wall |
| 37 | Edge region |
| 38 | Space |
| 39 | Wall |
| 40 | Opening |
| 41 | Longitudinal guide |
| 42 | Stop element |
| 43 | Container |
| 44 | Housing |
| VM | Full volume control level |
| TM | Part volume control level |
| S | Water level |

The invention claimed is:

1. A drainage fitting for a cistern, comprising:

a valve body with a sealing element, which cooperates with a valve seat, and a float, wherein the valve body is movable with the sealing element from the valve seat along a movement axis from a rest position into a flushing position and from the flushing position into the rest position, a full volume control unit for controlling a full volume flush, wherein the full volume control unit provides a closing force on the valve body when a respective water level that is provided for the full volume is achieved, a part volume control unit for controlling a part volume flush, wherein the part volume control unit provides a closing force on the valve body when a respective water level that is provided for the part volume is achieved, a partition wall, and a float chamber which is located below said partition wall, wherein the valve body extends through an opening through the partition wall, wherein the float is movable along an actuating axis inside the float chamber and hydraulically cooperates with said float chamber, wherein the partition wall comprises a full volume control opening and a part volume control opening, through which air and/or water is able to pass from a top side of the partition wall below said partition wall in such a manner that the pressure conditions between the float chamber and regions in the cistern outside the float chamber can be equalized, wherein the float is movable from the flushing position into the rest position when the pressure conditions are equalized, and wherein a state of the full volume control opening is controllable by the full volume control unit and a state of the part volume control opening is controllable by the part volume control unit.

2. The drainage fitting according to claim 1, wherein the closing force is applied directly onto the valve body from the full volume control unit or wherein the closing force is applied onto the valve body from the part volume control unit via a switching member.

3. The drainage fitting according to claim 1, wherein each of the control units includes a closing member which cooperates with the respective control opening, wherein each closing member is movable relative to its corresponding control opening.

4. The drainage fitting according to claim 3, wherein the full volume control unit includes an actuating rod which projects through the full volume control opening and acts directly on the float.

5. The drainage fitting according to claim 4, wherein the full volume control unit includes an actuating element with a water chamber and an air chamber which is located below the water chamber, wherein the actuating element communicates with the actuating rod, and wherein the part volume control unit includes an actuating element with a water chamber, wherein the actuating element is connectable to the valve body via the switching member and wherein the actuating element communicates with the rod, wherein the actuating element of the full volume control unit is located below the actuating element of the part volume control unit in an installed position and wherein the water chambers provide a weight force when the cistern empties which then acts as a closing force.

6. The drainage fitting according to claim 5, wherein the actuating element of the full volume control unit is moved in a first container, wherein said container is connected to the partition wall and comprises an outlet opening above the partition wall in a region of a bottom of the container.

7. The drainage fitting according to claim 6, wherein a second container, which extends away from the partition wall, is arranged in a region of the part volume control opening.

8. The drainage fitting according to claim 5, wherein the actuating element of the full volume control unit is configured so as to be height-adjustable along the actuating rod, and wherein the actuating element of the part volume control unit is configured so as to be height-adjustable along the rod.

9. The drainage fitting according to claim 5, wherein a container, which extends away from the partition wall, is arranged in a region of the part volume control opening.

10. The drainage fitting according to claim 4, wherein the actuating rod projects into the float chamber to an extent that, when the float moves from the rest position into the flushing position, the actuating rod and further parts of the full volume control unit are raised.

11. The drainage fitting according to claim 10, wherein the closing member of the full volume control unit is arranged on a front end region of the actuating rod.

12. The drainage fitting according to claim 11, wherein the actuating rod of the full volume control unit is suspended on a retaining element in the flushing position.

13. The drainage fitting according to claim 11, wherein the closing member of the full volume control unit is located inside a floating chamber in such a manner that the full volume control opening is closable in the rest position, the closure being ensured by a buoyancy of the actuating rod.

14. The drainage fitting according to claim 4, wherein the closing member of the full volume control unit is arranged on a front end region of the actuating rod.

15. The drainage fitting according to claim 14, wherein the actuating rod of the full volume control unit is suspended on a retaining element in the flushing position.

16. The drainage fitting according to claim 14, wherein the closing member of the full volume control unit is located inside the float chamber in such a manner that the full volume control opening is closable in the rest position, the closure being ensured by a buoyancy of the actuating rod.

17. The drainage fitting according to claim 4, wherein the actuating rod of the full volume control unit is suspended on a retaining element in the flushing position.

18. The drainage fitting according to claim 1, wherein the part volume control unit includes a switching member which, when the part volume control unit is raised, automatically enters into a latching connection to the valve body.

19. The drainage fitting according to claim 18, wherein the part volume control unit includes a rod, wherein a closing member is arranged on a front end region of the rod.

20. The drainage fitting according to claim 19, wherein the closing member is at least one of raised from the part volume control opening when the part volume control unit is actuated and located outside the float chamber.

21. The drainage fitting according to claim 19, wherein the drainage fitting additionally comprises an actuating device, wherein during the full volume flush the actuating device acts directly on the valve body, and wherein during the part volume flush the actuating device acts on the valve body via the part volume control unit, wherein the part volume control unit is raised during actuation and at the same time raises the valve body, wherein the part volume control unit is temporarily coupled to the valve body.

22. The drainage fitting according to claim 21, wherein the part volume control unit is temporarily coupled to the valve body via the switching member.

23. The drainage fitting according to claim 21, wherein the part volume control unit comprises a sleeve which communicates with the rod and surrounds the valve body at least in part, wherein the valve body comprises a stop against which the sleeve bears during the part volume flush in such a manner that the valve body can be raised.

24. The drainage fitting according to claim 23, wherein the valve body comprises a first receiving opening which engages with the actuating device and wherein the part volume control unit comprises a second receiving opening which engages with the actuating device.

25. The drainage fitting according to claim 24, wherein the actuating rod of the full volume control unit and the rod of the part volume control unit are movable along a longitudinal direction parallel to the movement of the valve body.

26. The drainage fitting according to claim 21, wherein the valve body comprises a first receiving opening which engages with the actuating device and wherein the part volume control unit comprises a second receiving opening which engages with the actuating device.

27. The drainage fitting according to claim 26, wherein the actuating rod of the full volume control unit and the rod of the part volume control unit are movable along a longitudinal direction parallel to the movement of the valve body.

28. The drainage fitting according to claim 1, wherein the full volume control opening and the part volume control opening are arranged in a portion of the partition wall located in the horizontal in an installed position.

29. The drainage fitting according to claim 1, wherein the drainage fitting further includes a housing which is fixedly connectable to the cistern, wherein the valve body is movably mounted in the housing.

30. The drainage fitting according to claim 1, wherein the full volume control opening and the part volume control opening are arranged in a portion of the partition wall located in the horizontal in an installed position, wherein the full volume control opening is arranged in a first section of the partition wall and the part volume control opening is arranged in a second section of the partition wall, whereby the first section and the second section are offset from each other with respect to a vertical axis.

* * * * *